US009677345B2

(12) United States Patent
Miller, Jr. et al.

(10) Patent No.: US 9,677,345 B2
(45) Date of Patent: Jun. 13, 2017

(54) WELL INTERVENTION APPARATUS AND METHOD

(71) Applicant: National Oilwell Varco, L.P., Houston, TX (US)

(72) Inventors: Joseph Hayden Miller, Jr., Lafayette, LA (US); Justin Dallas Broussard, Lafayette, LA (US)

(73) Assignee: National Oilwell Varco, L.P., Houston, TX (US)

( * ) Notice: Subject to any disclaimer, the term of this patent is extended or adjusted under 35 U.S.C. 154(b) by 0 days.

(21) Appl. No.: 14/722,212

(22) Filed: May 27, 2015

(65) Prior Publication Data

US 2016/0348448 A1 Dec. 1, 2016

(51) Int. Cl.

| | |
|---|---|
| ***E21B 15/02*** | (2006.01) |
| ***E21B 19/08*** | (2006.01) |
| ***E21B 19/084*** | (2006.01) |
| ***E21B 15/00*** | (2006.01) |

(52) U.S. Cl.
CPC ..... *E21B 15/003* (2013.01); *E21B 19/08* (2013.01); *E21B 19/084* (2013.01)

(58) Field of Classification Search
None
See application file for complete search history.

(56) References Cited

U.S. PATENT DOCUMENTS

| | | | |
|---|---|---|---|
| 2,187,392 | A | 1/1940 | Moncus et al. |
| 2,685,378 | A | 8/1954 | Stone |
| 3,302,709 | A | 2/1967 | Postlewaite |
| 3,308,881 | A | 3/1967 | Chan et al. |
| 3,658,298 | A | 4/1972 | Moore et al. |
| 3,681,928 | A | 8/1972 | Vincken et al. |

(Continued)

FOREIGN PATENT DOCUMENTS

| | | |
|---|---|---|
| CN | 104011317 | 8/2014 |
| WO | 0149966 | 7/2001 |

OTHER PUBLICATIONS

International Search Report and Written Opinion for PCT Application No. PCT/US2011/025699, mailed May 6, 2011 (10 pages).

(Continued)

*Primary Examiner* — Matthew R Buck
*Assistant Examiner* — Douglas S Wood
(74) *Attorney, Agent, or Firm* — Winthrop & Weinstine, P.A.

(57) ABSTRACT

A well intervention apparatus including a base frame assembly, a deck attached to an upper end of the base frame assembly. The deck includes a passage and a hatch adjacent to the passage. A track is disposed within the passage, and a movable plate is slidingly attached to the track for movement within the passage. A reception plate is attached over a first aperture of the moveable plate and a tower is mounted over a second aperture of the moveable plate. A primary hoist assembly is connected to an upper end of the tower. The reception plate is configured to secure a first well intervention tool, and the primary hoist assembly is configured to suspend a second well intervention tool from the tower. In a first position of the moveable plate, the reception plate is disposed over the well. In a second position, the tower is disposed over the well.

20 Claims, 20 Drawing Sheets

(56) References Cited

U.S. PATENT DOCUMENTS

| | | | | |
|---|---|---|---|---|
| 4,147,221 | A | 4/1979 | Ilfrey et al. | |
| 4,200,054 | A | 4/1980 | Elliston | |
| 4,208,158 | A * | 6/1980 | Davies | E21B 15/003 175/85 |
| 4,423,994 | A | 1/1984 | Schefers et al. | |
| 4,836,300 | A | 6/1989 | Reed | |
| 6,158,516 | A | 12/2000 | Smith et al. | |
| 6,343,893 | B1 | 2/2002 | Gleditsch | |
| 6,443,240 | B1 | 9/2002 | Scott | |
| 6,901,998 | B1 | 6/2005 | Roodenburg et al. | |
| 6,926,103 | B1 | 8/2005 | Roodenburg et al. | |
| 6,929,071 | B2 * | 8/2005 | Moncus | E21B 19/006 166/355 |
| 6,932,553 | B1 * | 8/2005 | Roodenburg | E21B 15/003 166/343 |
| 6,973,979 | B2 | 12/2005 | Carriere et al. | |
| 6,988,459 | B2 | 1/2006 | Roodenburg et al. | |
| 7,083,004 | B2 | 8/2006 | Roodenburg et al. | |
| 7,096,963 | B2 | 8/2006 | Moncus et al. | |
| 7,163,061 | B2 * | 1/2007 | Moncus | E21B 19/22 114/264 |
| 7,191,837 | B2 | 3/2007 | Coles | |
| 7,404,443 | B2 | 7/2008 | Patton et al. | |
| 7,789,155 | B2 * | 9/2010 | Moncus | E21B 19/22 166/313 |
| 8,555,974 | B2 | 10/2013 | Moncus et al. | |
| 8,672,039 | B2 | 3/2014 | Miller, III et al. | |
| 9,266,586 | B2 * | 2/2016 | Roodenburg | E21B 19/09 |
| 2001/0025727 | A1 | 10/2001 | Byrt et al. | |
| 2003/0106695 | A1 | 6/2003 | Fikes et al. | |
| 2004/0206551 | A1 | 10/2004 | Carriere et al. | |
| 2006/0011350 | A1 | 1/2006 | Wiggins et al. | |
| 2007/0089882 | A1 | 4/2007 | Patton et al. | |
| 2008/0099208 | A1 * | 5/2008 | Moncus | E21B 19/09 166/338 |
| 2008/0314580 | A1 | 12/2008 | Wood | |
| 2010/0038088 | A1 | 2/2010 | Springett et al. | |
| 2011/0067887 | A1 | 3/2011 | Moncus et al. | |
| 2012/0067642 | A1 | 3/2012 | Magnuson | |

OTHER PUBLICATIONS

International Search Report and Written Opinion for PCT Application No. PCT/US2016/034779, mailed Aug. 24, 2016 (11 pages).

* cited by examiner

WELL INTERVENTION APPARATUS AND METHOD

BACKGROUND OF THE INVENTION

In the drilling, completion, and production of hydrocarbons, an operator may find it necessary to perform various well intervention work on a wellbore. Coiled tubing may be used for well intervention operations, but requires positioning a coiled tubing injector head over the wellbore. Other well intervention components may need to be suspended from a derrick or tower that is positioned on the drilling rig over the wellbore. For example, wireline may be used for well intervention operations, such as for lowering equipment or measurement devices into the wellbore and monitoring the equipment or measurement devices. Wireline is inserted into the wellbore through a wireline lubricator, which is suspended from the tower.

In some cases, multiple well intervention devices may be required for a single wellbore at different time periods. But switching between well intervention devices may be time consuming. For example, a wireline lubricator may be suspended from the tower, but coiled tubing operations may need to be performed on the wellbore. In that situation, the wireline lubricator will need to be rigged down from the tower in order to allow space for positioning a coiled tubing injector head over the wellbore. Such disassembly may be time consuming and expensive.

DETAILED DESCRIPTION OF THE PREFERRED EMBODIMENTS

Figure 1:
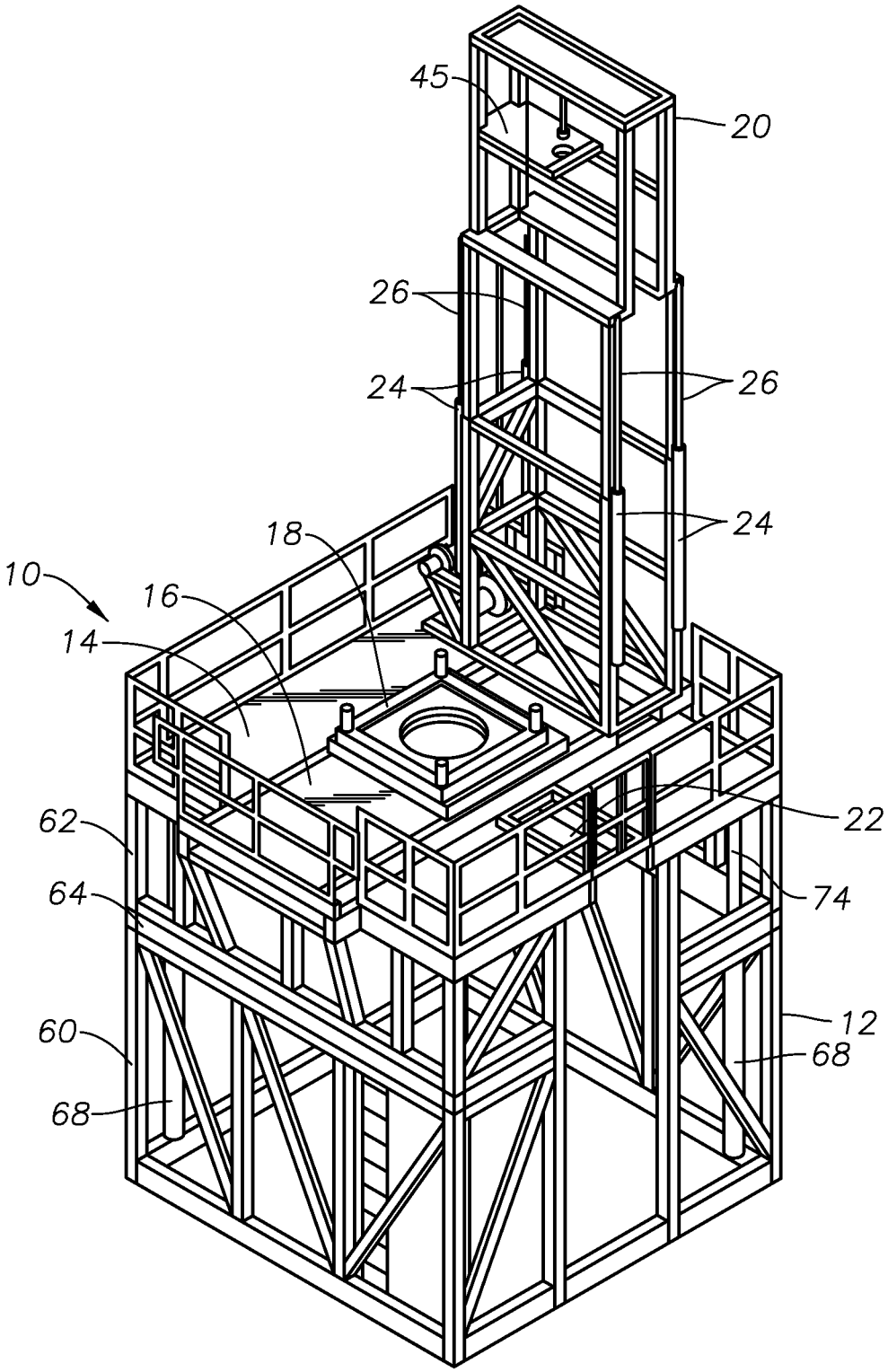
FIG. 1 is a perspective view of a well intervention apparatus.
Figure 2:
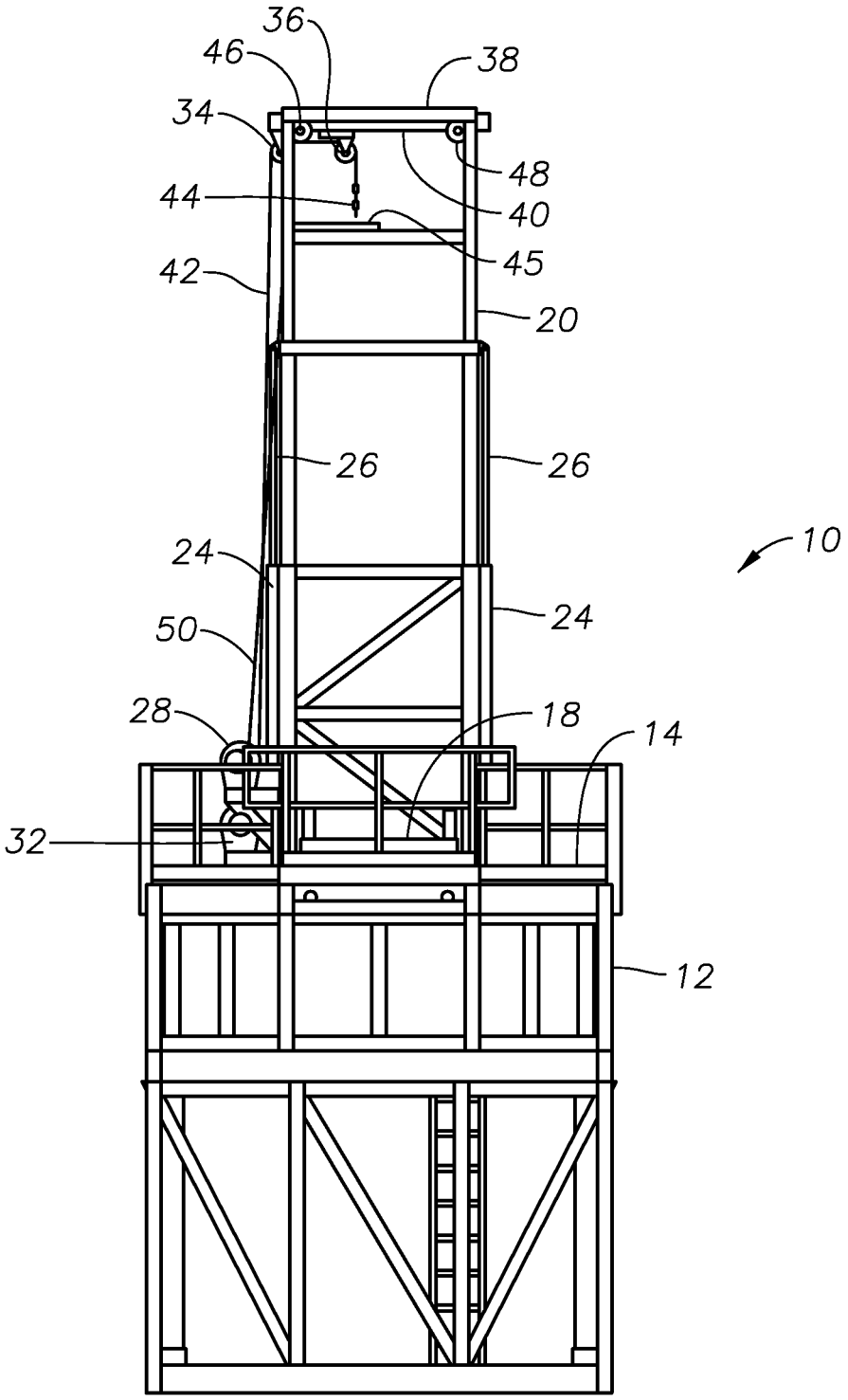
FIG. 2 is a front view of the well intervention apparatus.
Figure 3:
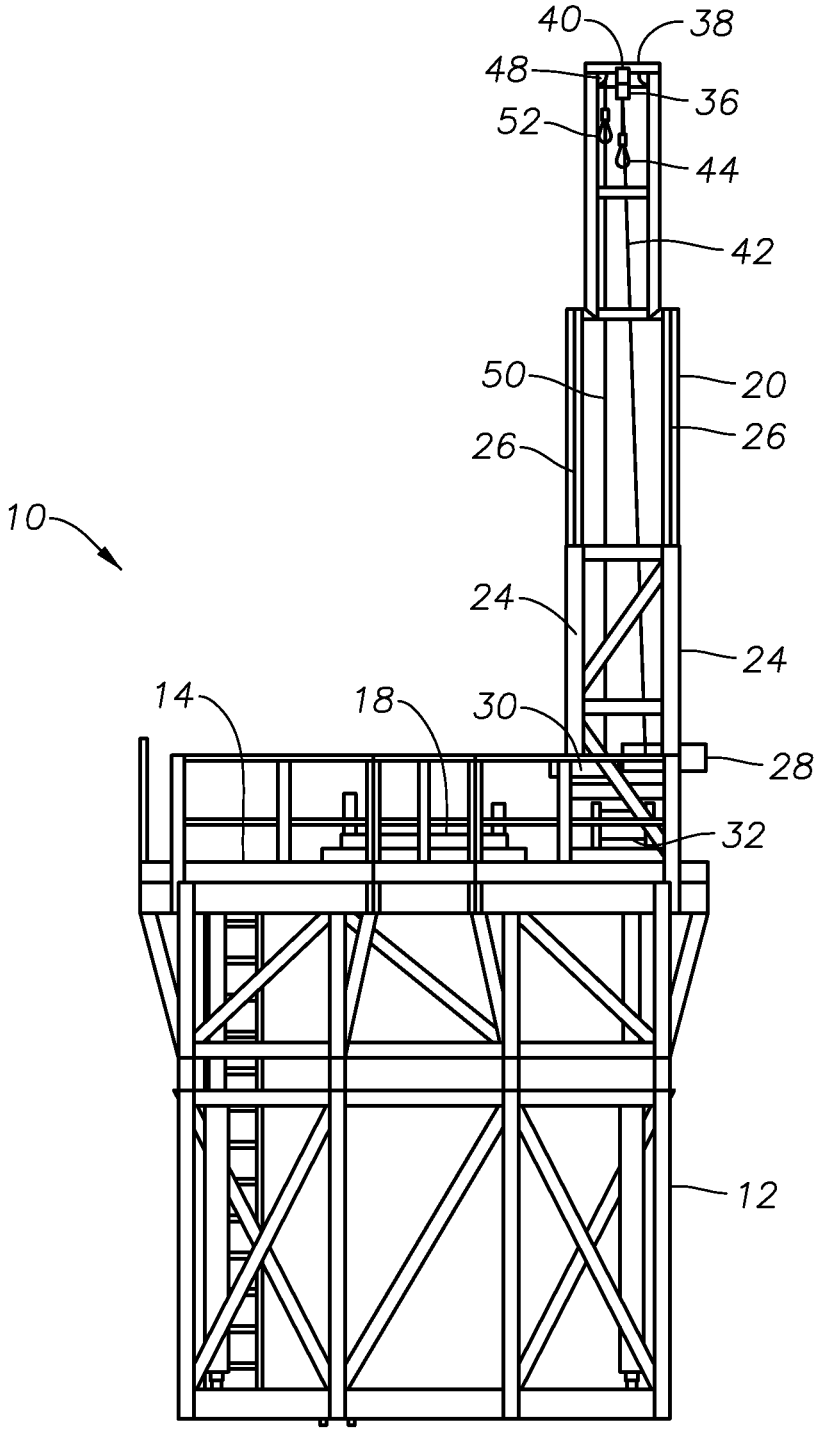
FIG. 3 is a side view of the well intervention apparatus.

FIGS. 1-3 illustrate well intervention apparatus 10, which includes base frame assembly 12 and deck 14 at the upper end of base frame assembly 12. Movable plate 16 is slidingly attached within a passage of deck 14. Reception plate 18 and tower 20 may be mounted on movable plate 16, such that both reception plate 18 and tower 20 move along with moveable plate 16. Reception plate 18 may be designed to engage and secure a coiled tubing injector head onto moveable plate 16. Tower 20 may be designed to suspend various types of equipment. Deck 14 may include hatch 22, which may be opened in order to allow entry of tools onto deck 14 and to allow for access to the passage of deck 14. Sliding of moveable plate 16 may facilitate alternating between equipment attached to reception plate 18 and equipment suspended from tower 20 over a wellbore without movement of base frame assembly 12. Similarly, movement of reception plate 18 may facilitate alignment of equipment mounted on reception plate 18 with a wellbore disposed below well intervention apparatus 10.

Figure 4:
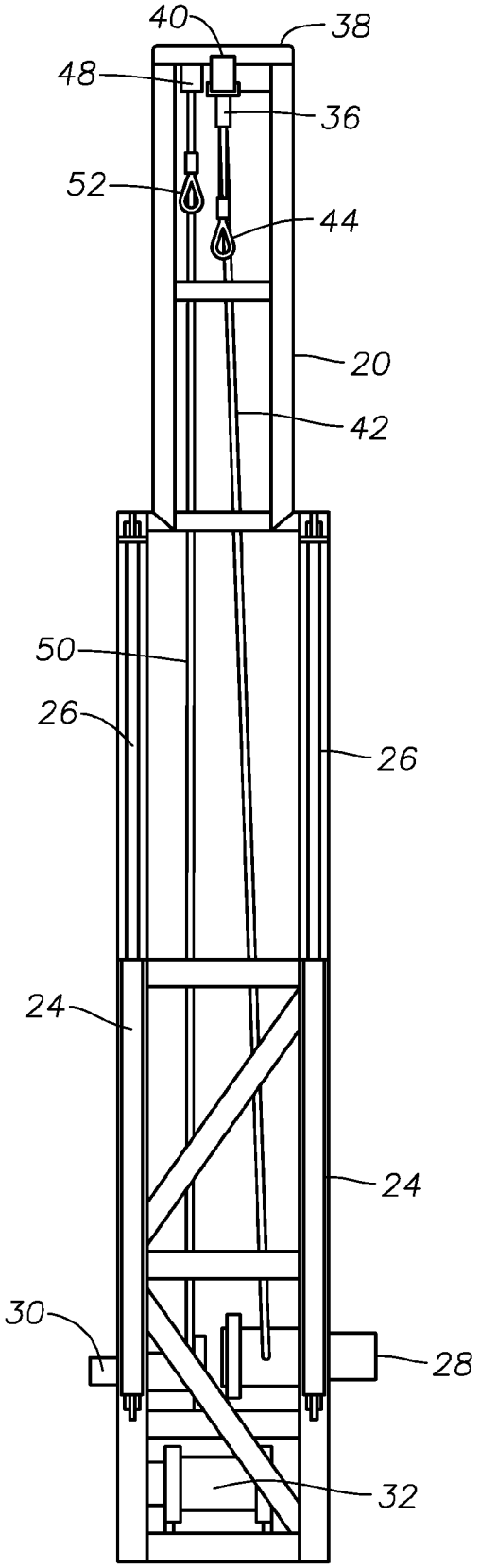
FIG. 4 is a side view of a tower of the well intervention apparatus.
Figure 5:
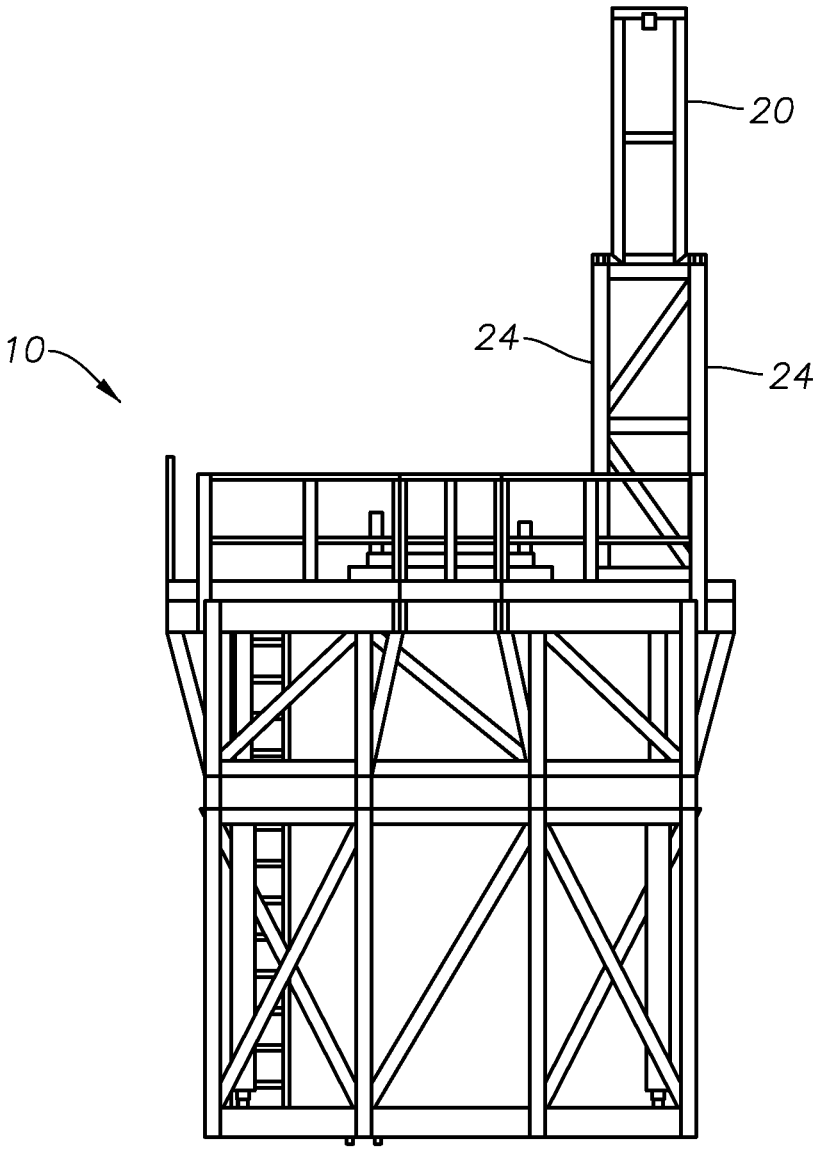
FIG. 5 is a side view of the well intervention apparatus with the tower in a contracted position.

With reference to FIGS. 1-5, tower 20 may include at least one cylinder 24 and cooperating piston 26 for extending and retracting tower 20. In one embodiment, tower 20 may include two or four sets of cylinders 24 and pistons 26. FIG. 4 illustrates tower 20 in an extended position due to extension of pistons 26. FIG. 5 illustrates tower 20 in a retracted position due to retraction of pistons 26 into cylinder 24. Tower 20 may be placed in a retracted position in order to avoid obstructions on a platform or rig on which well intervention apparatus 10 is positioned, as explained more fully below in connection with FIG. 27.

Referring again to FIGS. 1-4, primary drum 28, auxiliary drum 30, and wireline drum 32 may be mounted on a lower end of tower 20. First primary sheave 34 and second primary sheave 36 may be operatively attached to upper end 38 of tower 20. Second primary sheave 36 may be slidingly attached to upper track 40, which is attached to upper end 38 of tower 20. Support line 42 may be disposed around primary drum 28 and may engage first primary sheave 34 and second primary sheave 36, such that distal end 44 of support line 42 is suspended from second primary sheave 36. A connection device may be attached to distal end 44 of support line 42 for suspending equipment from tower 20. Rotation of primary drum 28 may be used to lift and lower the equipment suspended by support line 42 from second primary sheave 36. Additionally, second primary sheave 36 may be transferred along upper track 40 to laterally transfer the suspended equipment. A rack and pinion arrangement may be used for the movement of second primary sheave 36 along upper track 40. Alternatively, a hydraulic cylinder arrangement may be used for this movement. Tower 20 may also include plate 45 having an opening for stabilizing equipment suspended by support line 42.

First auxiliary sheave 46 and second auxiliary sheave 48 may be operatively attached to upper end 38 of tower 20. Auxiliary line 50 may be disposed around auxiliary drum 30 and may engage first auxiliary sheave 46 and second auxiliary sheave 48, such that distal end 52 of auxiliary line 50 is suspended from second auxiliary sheave 48. A connection device may be attached to distal end 52 of auxiliary line 50 for suspending additional equipment from tower 20. Rotation of auxiliary drum 30 may be used to lift and lower the equipment suspended by auxiliary line 50 from second auxiliary sheave 48.

Figure 6:
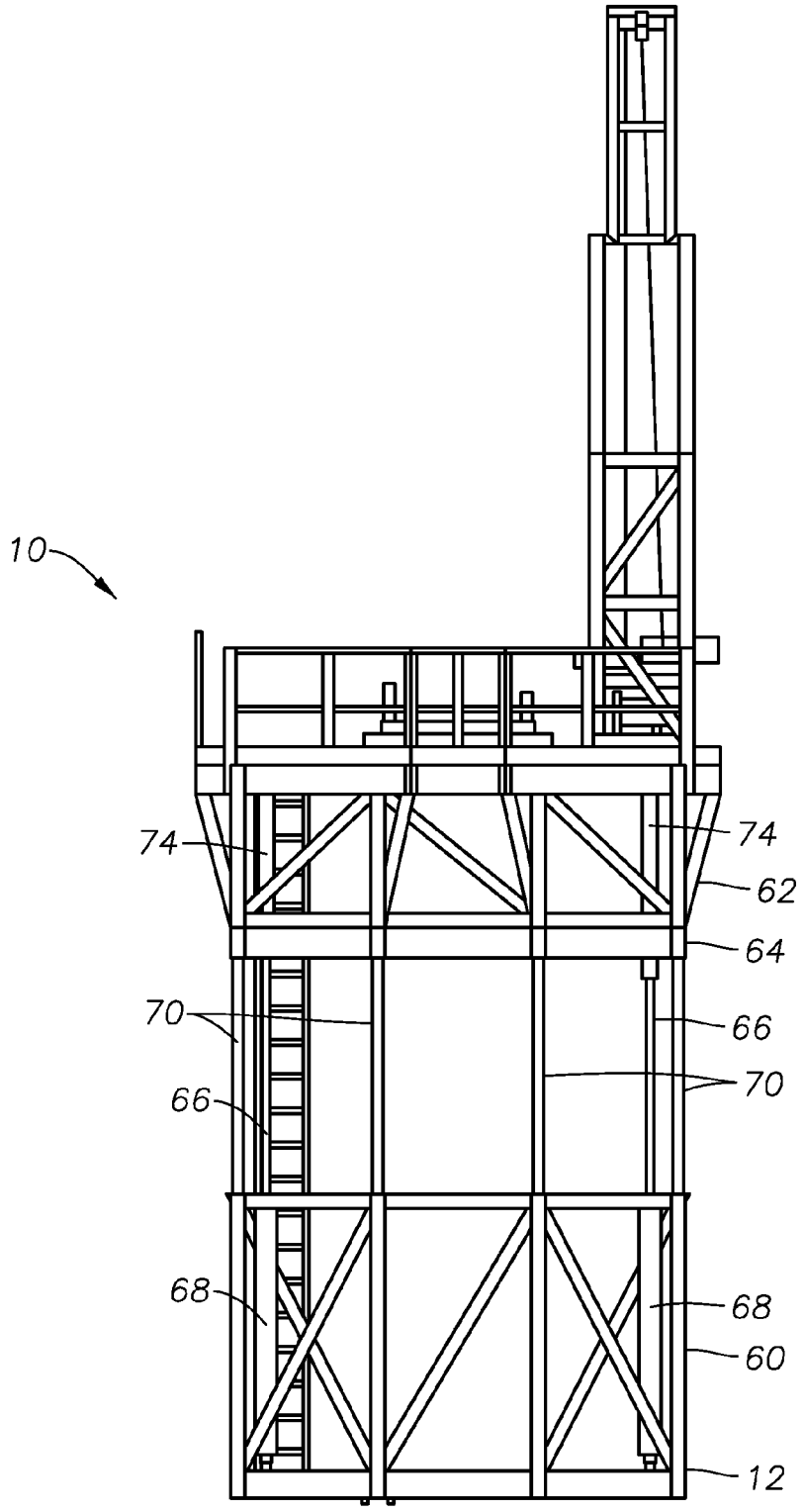
FIG. 6 is a side view of the well intervention apparatus with a base frame assembly of the apparatus in a partially extended position.
Figure 7:
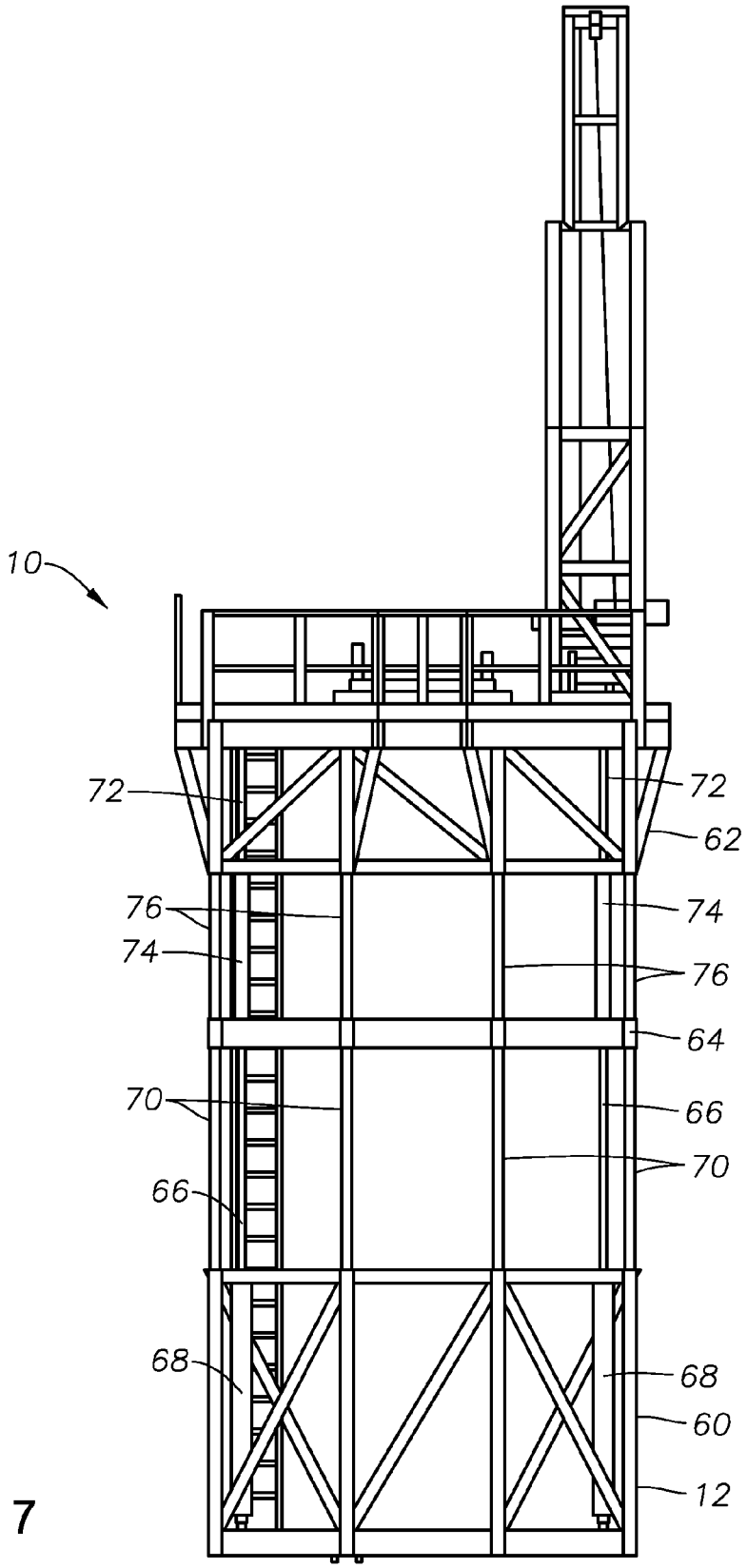
FIG. 7 is a side view of the well intervention apparatus with the base frame assembly in a fully extended position and a moveable plate of the apparatus in a first position.
Figure 8:
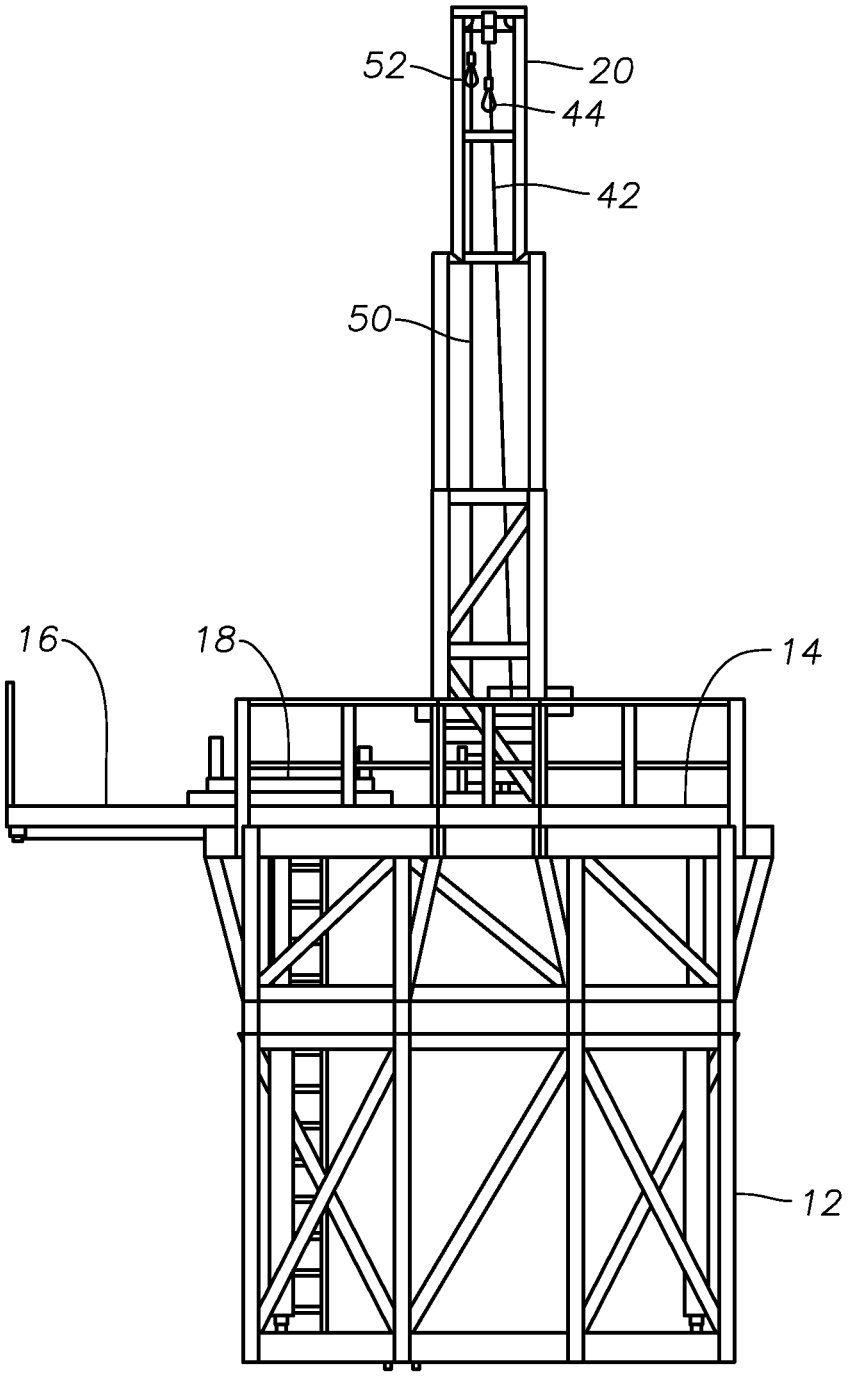
FIG. 8 is a side view of the well intervention apparatus with the moveable plate in a second position.
Figure 9:
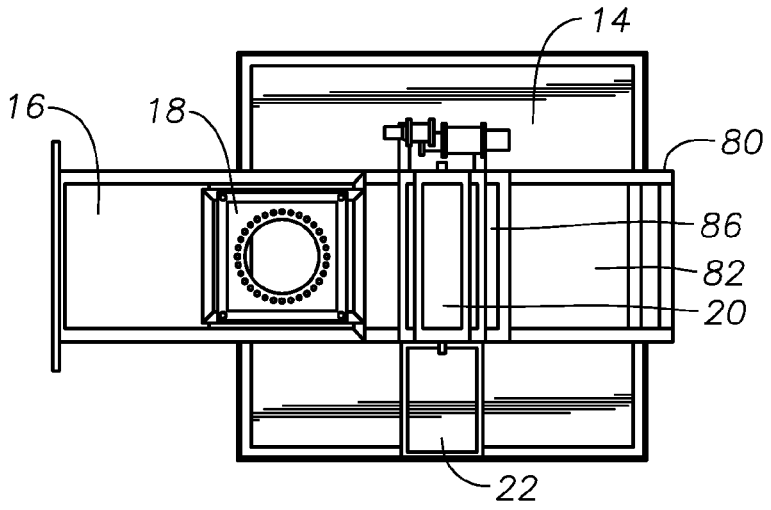
FIG. 9 is a top view of the well intervention apparatus with the moveable plate in the second position.

With reference now to FIGS. 1 and 6-7, base frame assembly 12 may include lower frame member 60, upper frame member 62, and central frame member 64 positioned between lower frame 60 and upper frame 62. Base frame assembly 12 may be extendable, such as by separating central member 64 from lower frame 60 and from upper frame 62. For example, base frame assembly 12 may be extended into a partially extended position shown in FIG. 6 by separating lower frame member 60 and central frame member 64, such as by extending pistons 66 from cylinders 68 that are connected to both lower frame member 60 and central frame member 64. Base frame assembly 12 may further include extension legs 70 extending between lower frame member 60 and central frame member 64. Extension legs 70 may slide into a portion of lower frame member 60 when base frame assembly 12 is in the contracted position shown in FIG. 1. In one embodiment, base frame assembly 12 may include 4 pistons 66 and cylinders 68 and 4-8 extension legs 70.

Base frame assembly 12 may be further extended into a fully extended position shown in FIG. 7 by separating upper frame member 62 and central frame member 64, such as by extending pistons 72 from cylinders 74 that are connected to both upper frame member 62 and central frame member 64. Base frame assembly 12 may further include extension legs 76 extending between upper frame member 62 and central frame member 64. Extension legs 76 may slide into a portion of upper frame member 62 when base frame assembly 12 is in the contracted position shown in FIG. 1 and in the partially extended position shown in FIG. 6. In one embodiment, base frame assembly 12 may include four pistons 72 and cylinders 74 and between four and eight extension legs 76.

Well intervention apparatus 10 may be mounted on a tension leg platform in a water body over a subsea well. Alternatively, well intervention apparatus 10 may be mounted on any other structure that is subjected to variations in sea level in the water body. Pistons 66 and 72 may extend and contract in response to a sea level change in the water body. In one embodiment, base frame assembly 12 may function as the motion compensation structure described in U.S. Pat. No. 6,929,071 to Devin International, Inc., which is fully incorporated by reference herein.

Figure 10:
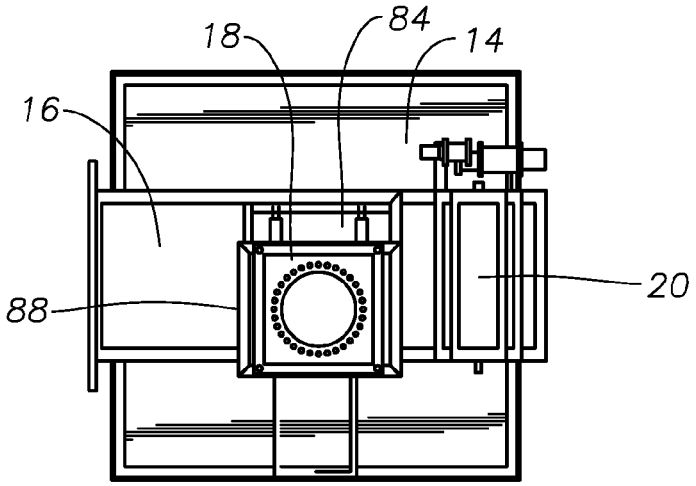
FIG. 10 is a top view of the well intervention apparatus with a reception plate displaced in a forward direction.
Figure 11:
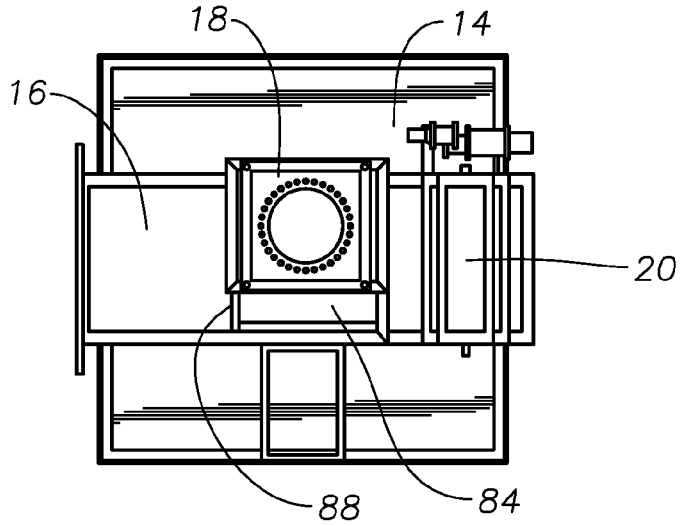
FIG. 11 is a top view of the well intervention apparatus with the reception plate displaced in a rearward direction.

Referring now to FIGS. 8-11, deck 14 may include track 80 disposed within passage 82. Moveable plate 16 may be slidingly attached to track 80. Reception plate 18 may be attached to moveable plate 16 over first aperture 84 of moveable plate 16. Tower 20 may be attached to moveable plate 16 over second aperture 86 of moveable plate 16. Moveable plate 16 may slide along track 80 from the first position shown in FIG. 1 to the second position shown in FIGS. 8 and 9. The sliding of moveable plate 16 along track 80 may be controlled by a hydraulic cylinder arrangement as fully understood by one of ordinary skill in the art. In this way, reception plate 18 and tower 20 may be transferred along the length of deck 14. Sliding of moveable plate 16 facilitates alternating between equipment attached to reception plate 18 and equipment suspended from tower 20 over a wellbore without movement of base frame assembly 12. Second track 88 may be positioned over first aperture 84 of moveable plate 16, and reception plate 18 may be slidingly attached to second track 88. Second track 88 may be perpendicularly oriented relative to track 80. Reception plate 18 may slide along second track 88 in a lateral direction as shown in FIGS. 10 and 11. The sliding of reception plate 18 along second track 88 may be controlled by a hydraulic cylinder arrangement and may facilitate alignment of equipment mounted on reception plate 18 with a wellbore disposed below well intervention apparatus 10.

Figure 12:
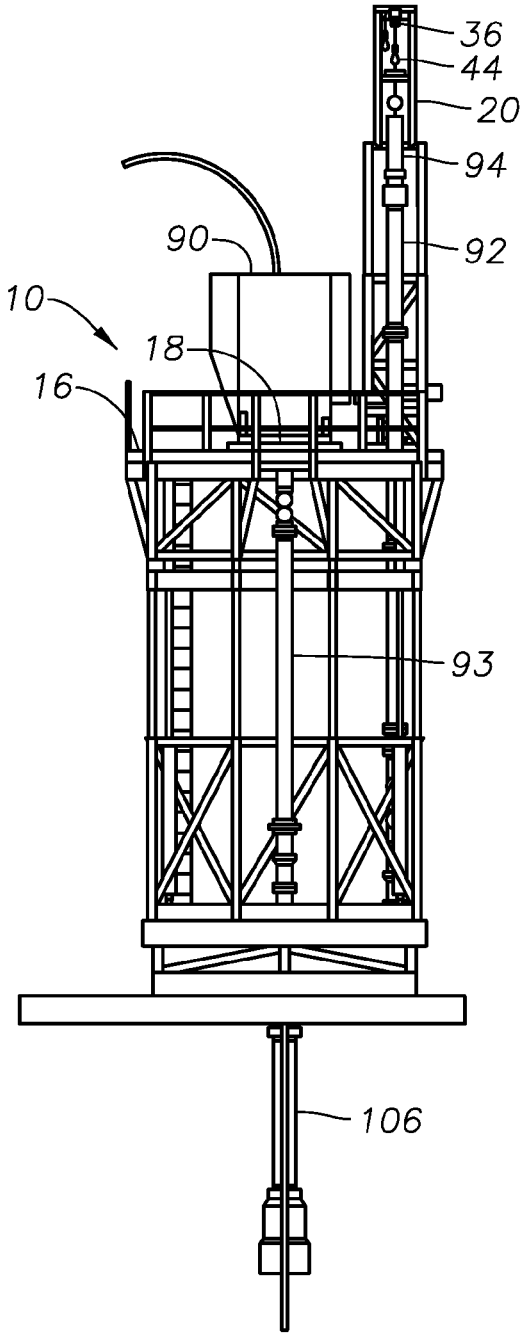
FIG. 12 is a side view of the well intervention apparatus supporting a coiled tubing injector head and a wireline lubricator with the moveable plate in the first position.
Figure 13:
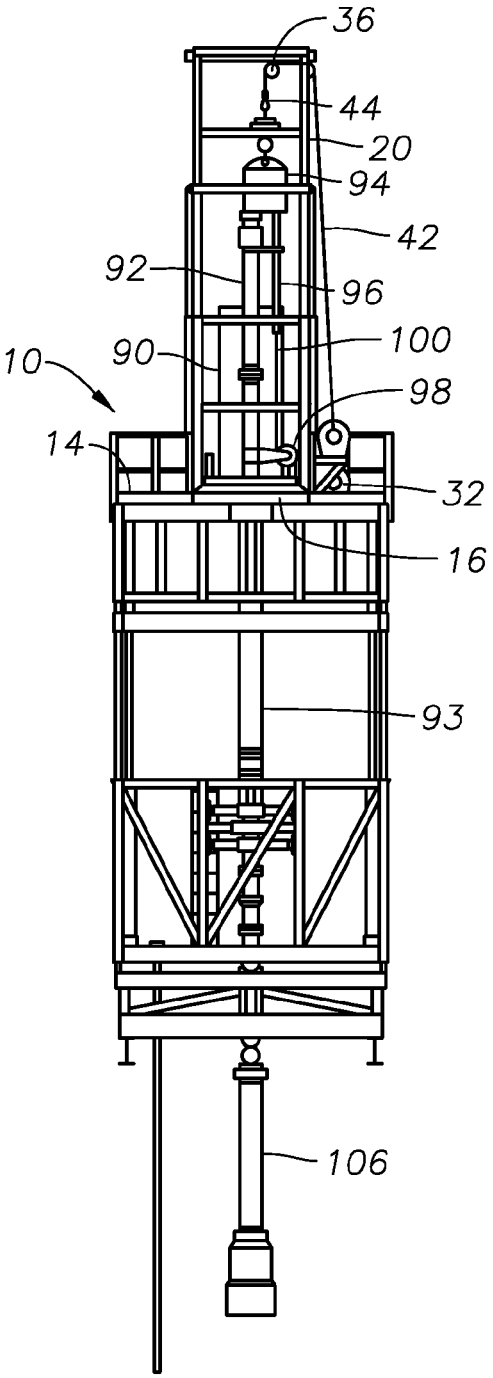
FIG. 13 is a rear view of the well intervention apparatus supporting the coiled tubing injector head and the wireline lubricator with the moveable plate in the first position.

With reference to FIGS. 12-13, well intervention apparatus 10 supports coiled tubing injector head 90 and wireline lubricator assembly 92. Coiled tubing injector head 90 may be connected to and mounted on reception plate 18 on moveable plate 16 with coiled tubing lubricator 93 suspended from reception plate 18. Wireline lubricator assembly 92 may be suspended from tower 20. More specifically, block 94 may be suspended from distal end 44 of support line 42, with wireline lubricator assembly 92 and wireline guide 96 suspended from block 94. Lower guide sheave 98 may be attached to wireline lubricator assembly 92 with lower guide sheave 98 positioned below wireline guide 96. Wireline 100 may be wrapped around wireline drum 32. Wireline 100 may extend from wireline drum 32, around lower guide sheave 98, up through wireline guide 96, through block 94, and into wireline lubricator assembly 92. Wireline lubricator assembly 92 may be configured to run wireline 100 into a wellbore located below well intervention apparatus 10 when tower 20 is positioned over the wellbore.

Figure 15:
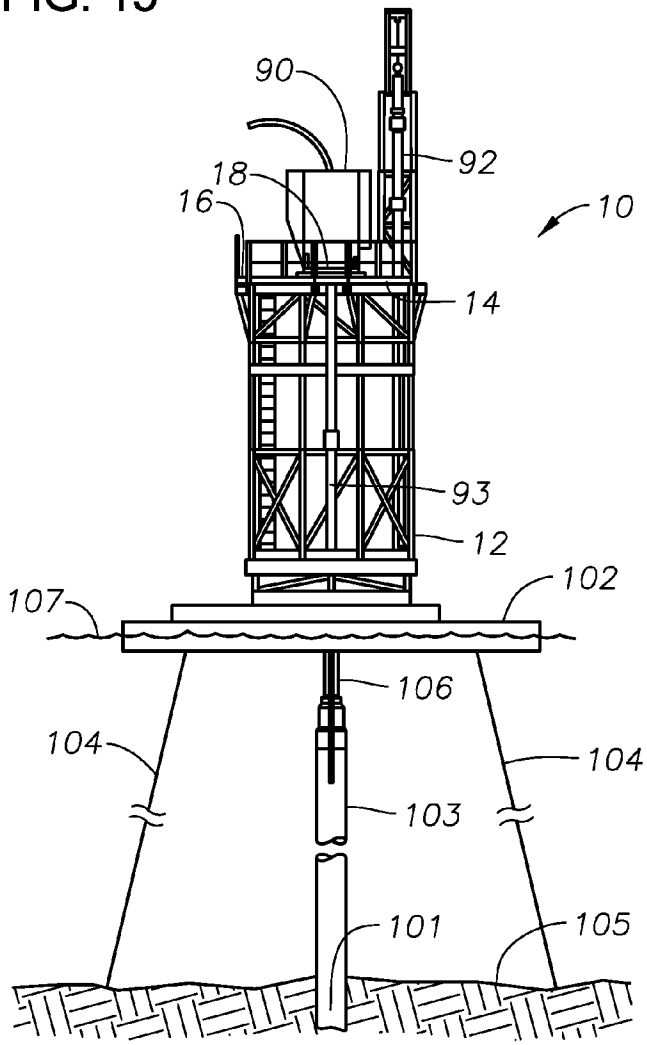
FIG. 15 is another schematic view of the well intervention apparatus positioned on the tension leg platform, with the moveable plate in the first position.
Figure 14:
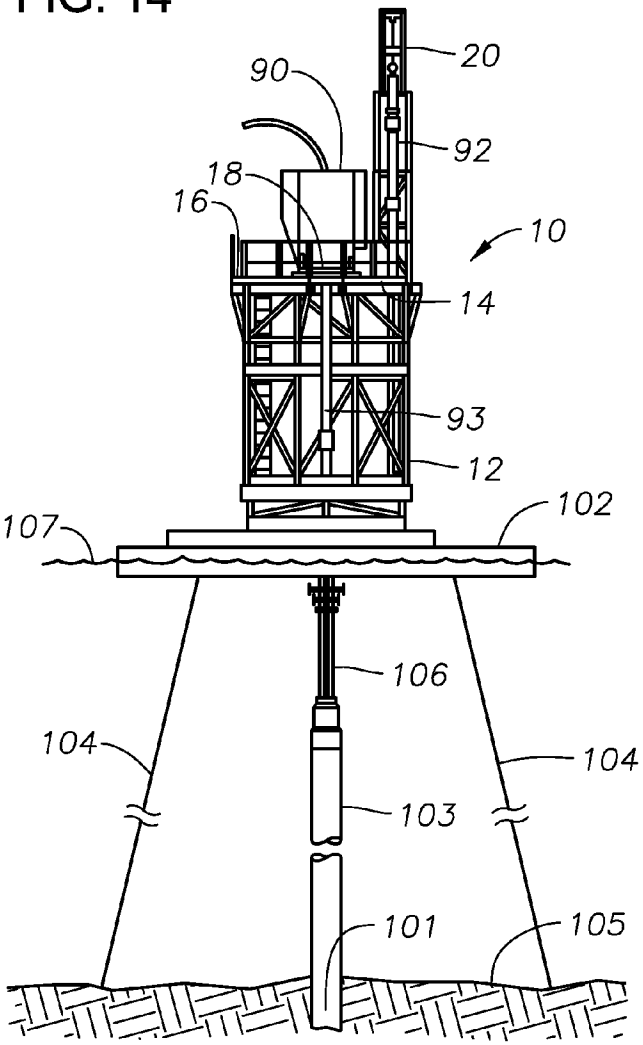
FIG. 14 is a schematic view of the well intervention apparatus positioned on a tension leg platform over a subsea wellbore, with the moveable plate in the first position.
Figure 16:
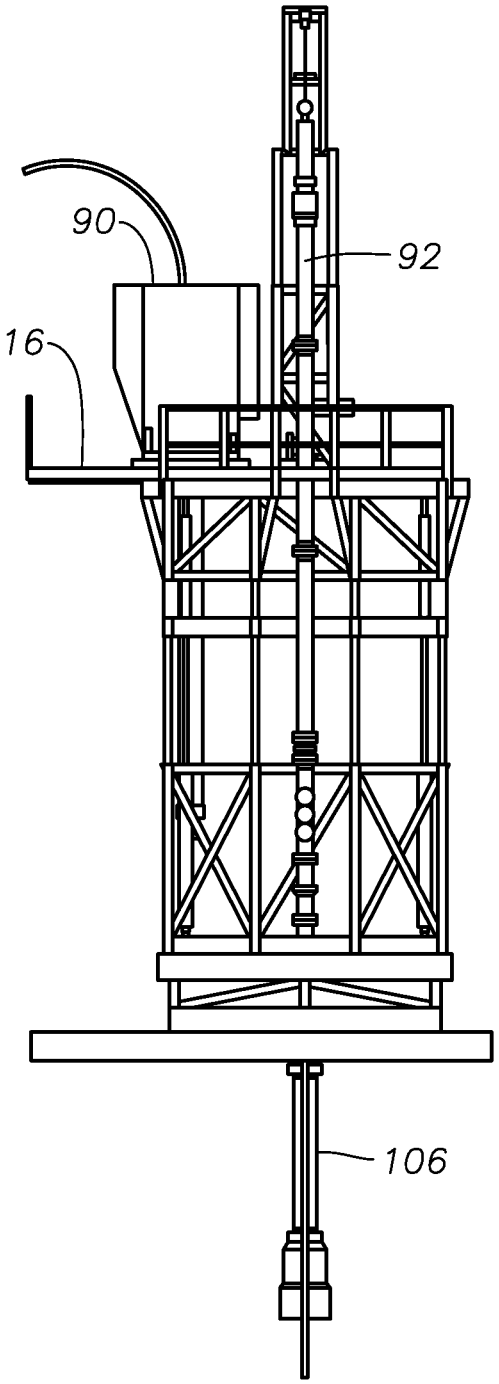
FIG. 16 is a side view of the well intervention apparatus supporting the coiled tubing injector head and the wireline lubricator with the moveable plate in the second position.
Figure 17:
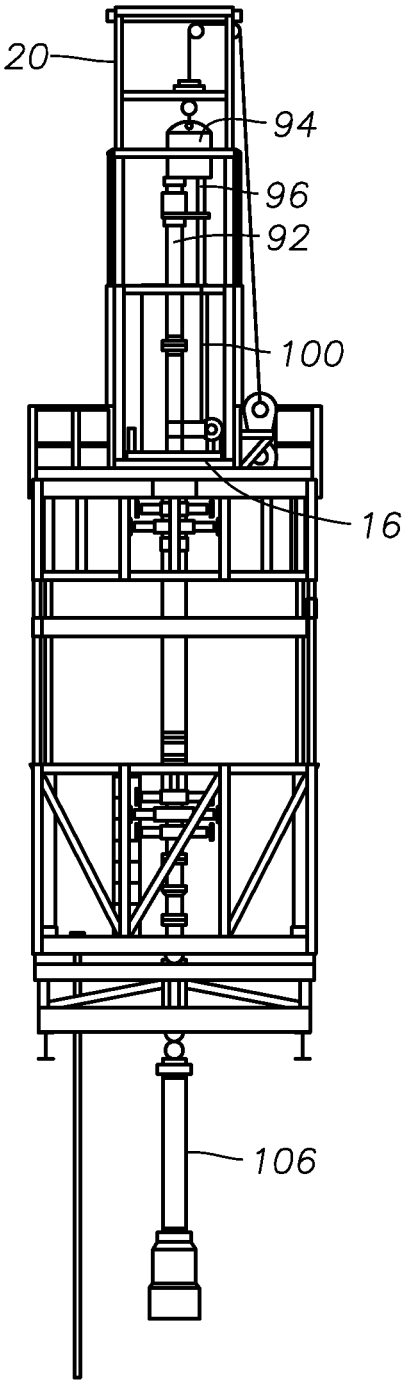
FIG. 17 is a rear view of the well intervention apparatus supporting the coiled tubing injector head and the wireline lubricator with the moveable plate in the second position.

Well intervention apparatus 10 may be positioned over a wellbore that requires well intervention work with coiled tubing or wireline equipment. As shown in FIGS. 14-15 for example, well intervention apparatus 10 may be positioned over wellbore 101 on tension leg platform 102 in a water body, with subsea wellbore 101 disposed below platform 102 and riser 103 extending from the sea floor to platform 102. Cables 104 may extend from sea floor 105 to platform 102, and may be formed of steel cables or any other sufficiently durable cable member. In this embodiment, well intervention apparatus 10 may be positioned on the platform such that the central portion of deck 14 is aligned with riser 103 and wellbore 101. If and when coiled tubing work is required in wellbore 101, moveable plate 16 may be placed in the first position shown in FIGS. 12-15 such that reception plate 18, coiled tubing injector head 90, and coiled tubing lubricator 93 are positioned over riser 103 and wellbore 101. Coiled tubing lubricator 93 may be fluidly connected to riser extension 106, which is fluidly connected to riser 103 extending from sub surface wellbore 101. Base frame assembly 12 may compensate for changes in sea level 107 during use of the coiled tubing equipment of well intervention apparatus 10. In other words, when sea level 107 drops as shown in FIG. 15, base frame assembly 12 is extended in order to maintain the elevation of coiled tubing injector head 90. Conversely, when sea level 107 rises as shown in FIG. 14, base frame assembly 12 is contracted in order to maintain the elevation of coiled tubing injector head 90.

Figure 19:
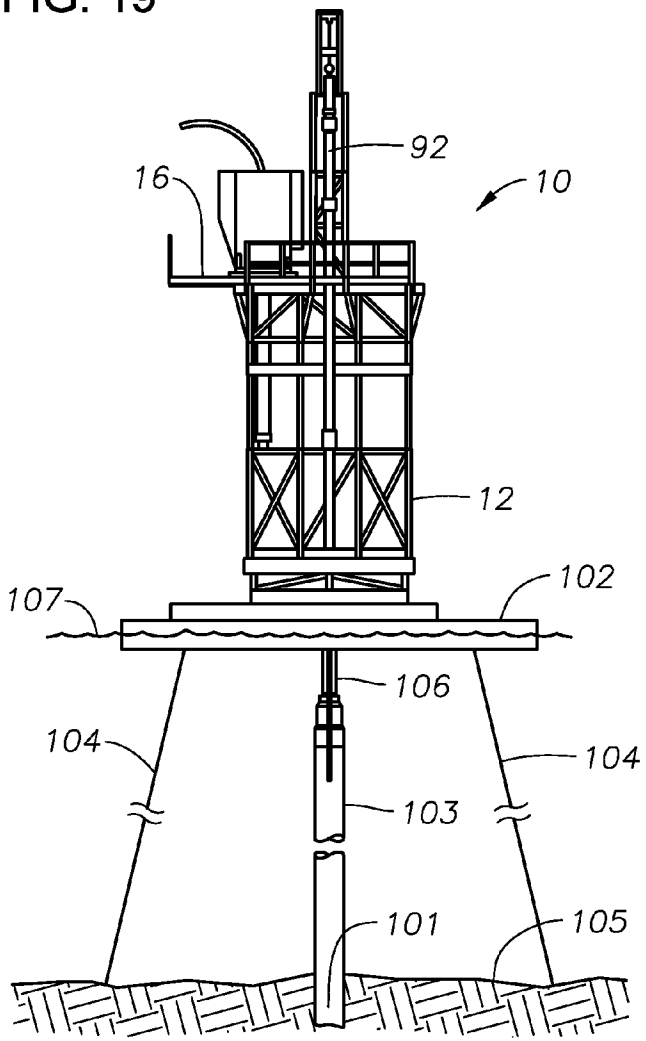
FIG. 19 is another schematic view of the well intervention apparatus positioned on the tension leg platform, with the moveable plate in the second position.
Figure 18:
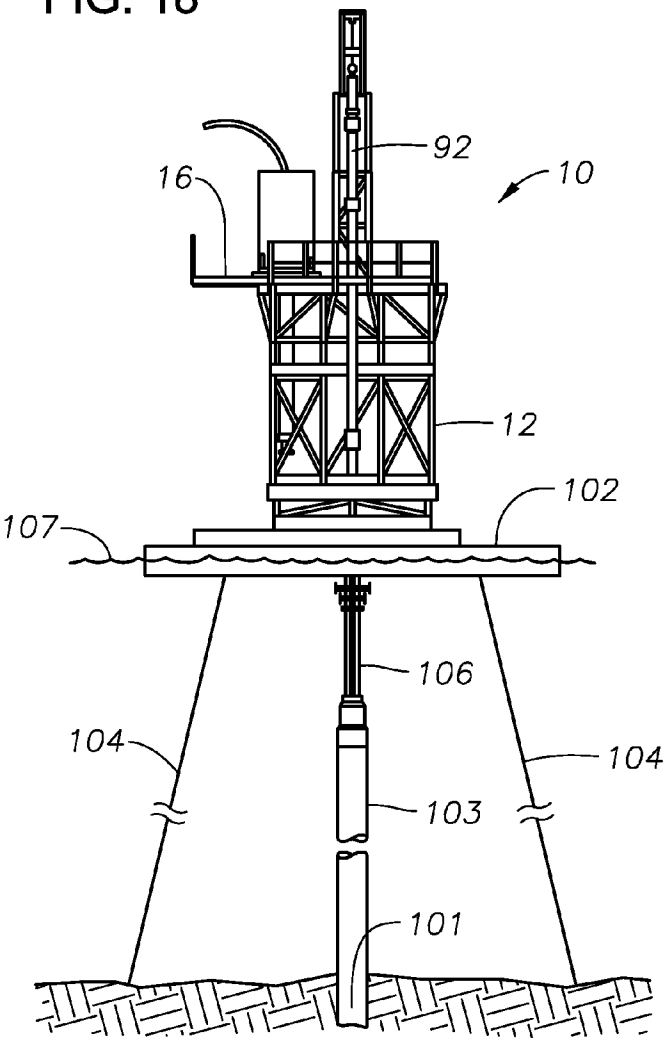
FIG. 18 is a schematic view of the well intervention apparatus positioned on the tension leg platform, with the moveable plate in the second position.

If and when wellbore 101 requires wireline intervention work, moveable plate 16 may be placed in the second position shown in FIGS. 16-19 such that wireline lubricator assembly 92 is disposed above wellbore 101. Wireline lubricator assembly 92 may be fluidly connected to riser extension 106, riser 103, and subsea wellbore 101. Base frame assembly 12 may compensate for changes in sea level 107 with moveable plate 16 in the second position. When sea level 107 drops as shown in FIG. 19, base frame assembly 12 is extended in order to maintain the elevation of wireline lubricator assembly 92. Conversely, when sea level 107 rises as shown in FIG. 18, base frame assembly 12 is contracted to maintain the elevation of wireline lubricator assembly 92.

Moveable plate 16 may be moved between the first position shown in FIGS. 12-15 and the second position shown in FIGS. 16-19 depending upon the type of work required within wellbore 101. Before transferring moveable plate 16 from the first position, coiled tubing lubricator 93 must be disconnected from riser extension 106. Base frame assembly 12 may be extended to provide additional clearance for this disconnection of coiled tubing lubricator 93 from riser extension 106. After moveable plate 16 is transferred into the second position, an extension of base frame assembly 12 may also provide additional clearance for connecting wireline lubricator assembly 92 to riser extension 106. Similarly, before transferring moveable plate 16 from the second position, wireline lubricator assembly 92 must be disconnected from riser extension 106. Base frame assembly 12 may be extended to provide additional clearance for this disconnection of wireline lubricator assembly 92 from riser extension 106. After moveable plate 16 is transferred into the first position, an extension of base frame assembly 12 may also provide additional clearance for connecting coiled tubing lubricator 93 to riser extension 106.

Figure 20:
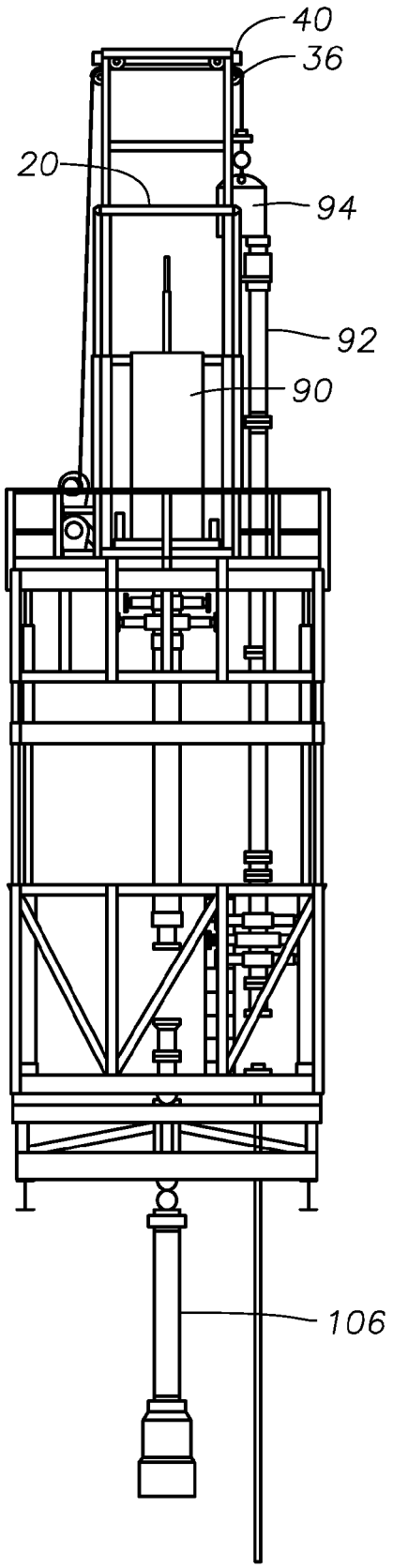
FIG. 20 is a front view of the well intervention apparatus supporting the coiled tubing injector head and the wireline lubricator with a sheave suspending the wireline lubricator in a sideline position.

With moveable plate 16 in the first position, reception plate 18 may be transferred along second track 88 (shown in FIGS. 10 and 11) to laterally slide coiled tubing lubricator 93 relative to riser extension 106, which may facilitate easier connection of coiled tubing lubricator 93 to riser extension 106. With moveable plate 16 in the second position, second primary sheave 36 may be transferred along upper track 40 to move wireline lubricator assembly 92 from an aligned position shown in FIGS. 16 and 17, in which wireline lubricator assembly 92 is aligned with riser extension 106 and wellbore 101, to a sideline position shown in FIG. 20. In the sideline position, wireline lubricator assembly 92 may be laterally displaced from (i.e., out of line with) riser extension 106 and the wellbore. Hatch 22 (shown in FIG. 1) may be opened to allow space for the lateral movement of wireline lubricator assembly 92 into the sideline position.

Figure 21:
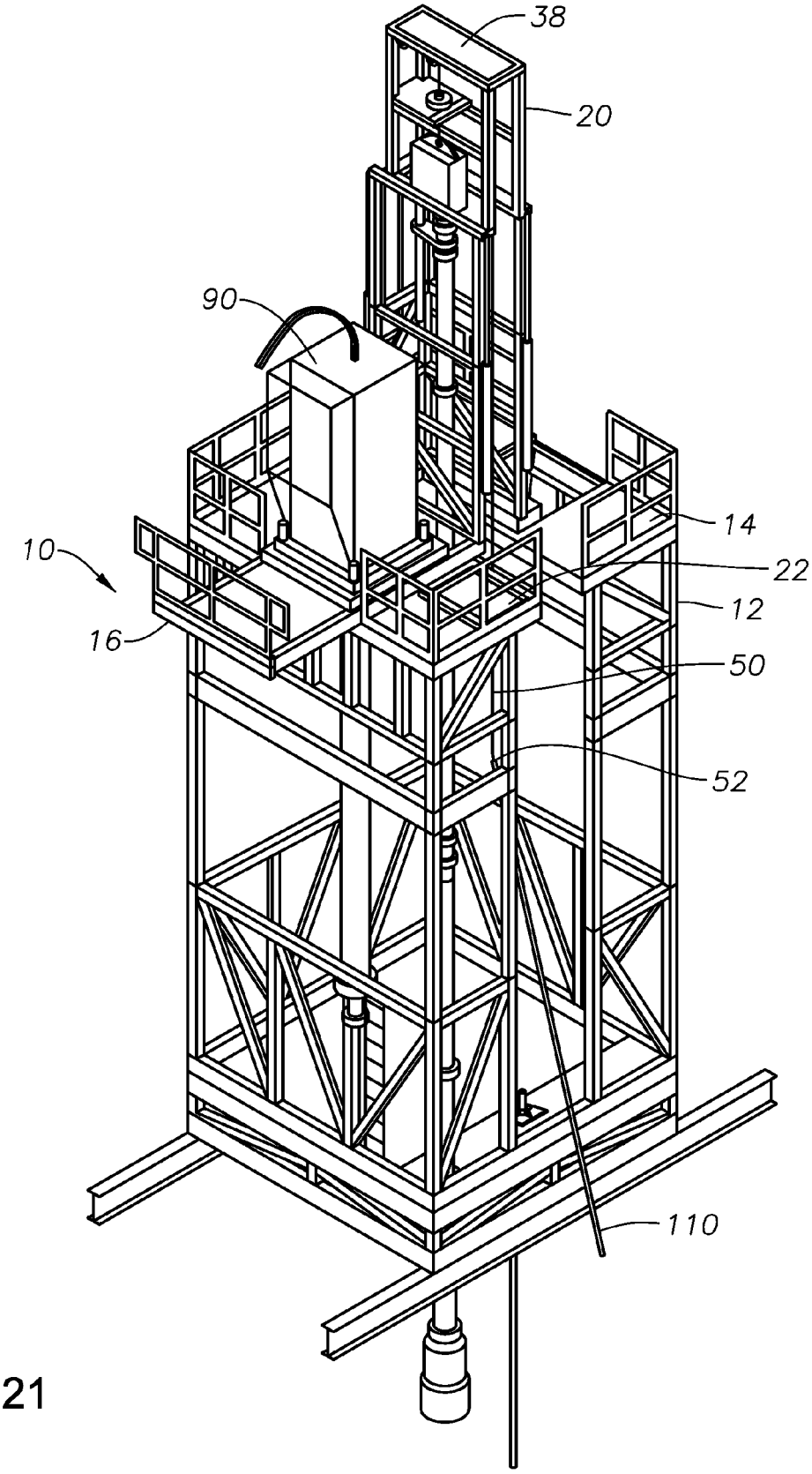
FIG. 21 is a perspective view of the well intervention apparatus lifting a wireline perforating gun.
Figure 22:
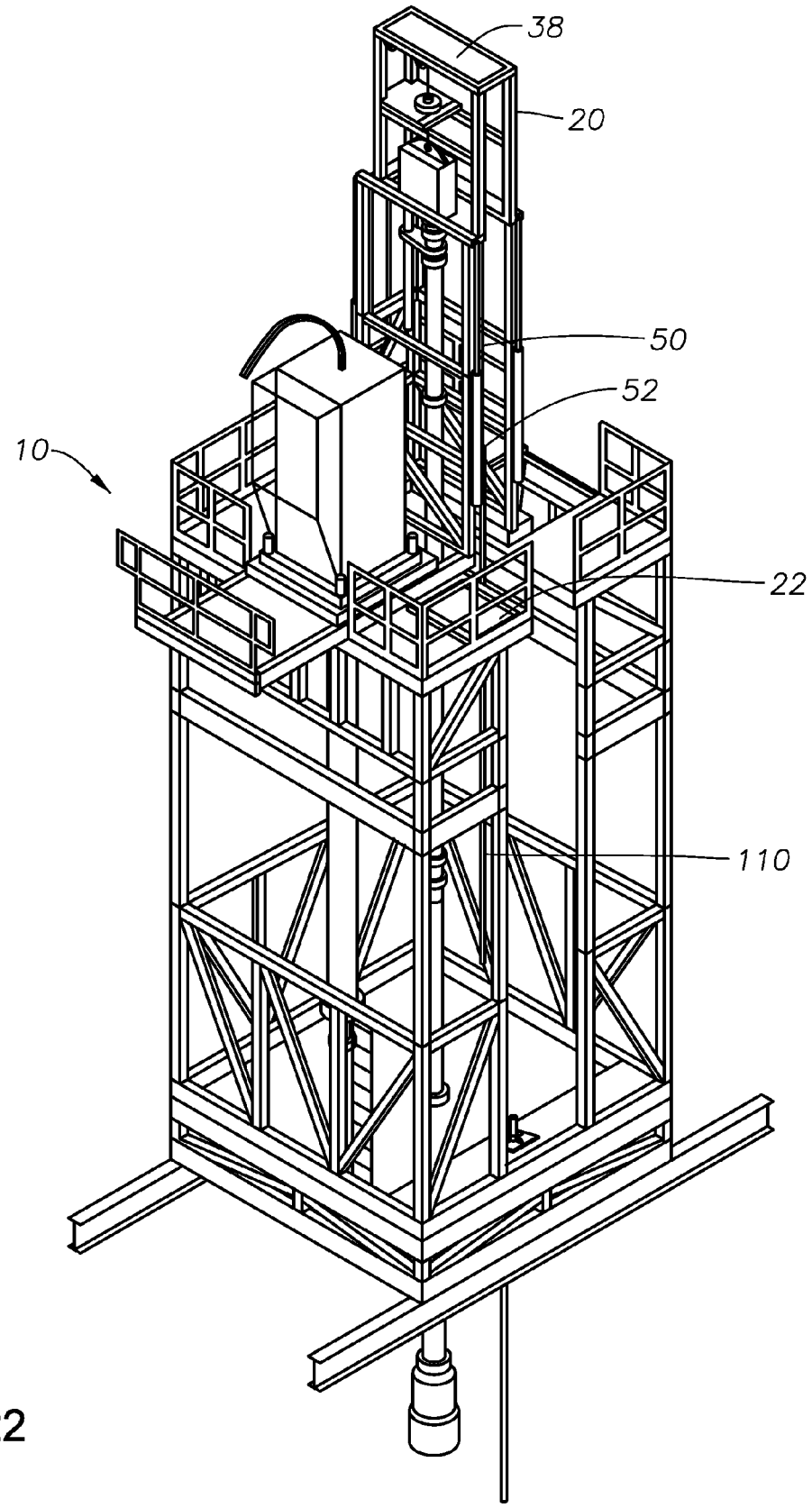
FIG. 22 is a perspective view of the well intervention apparatus suspending the wireline perforating gun.

Tower 20 of well intervention apparatus 10 may be used to suspend a variety of equipment types, such as with auxiliary line 50. For example, tower 20 may be used to suspend a wireline perforating gun over a wellbore and to run the wireline perforating gun into the wellbore. With reference to FIGS. 21-22 for example, wireline perforating gun 110 may be attached to distal end 52 of auxiliary line 50. Auxiliary drum 30 (shown in FIG. 3-4) may be rotated to retract auxiliary line 50 thereby drawing wireline perforating gun 110 toward upper end 38 of tower 20 as shown in FIG. 22. Hatch 22 may be open during this operation to allow clearance for wireline perforating gun 110.

Figure 23:
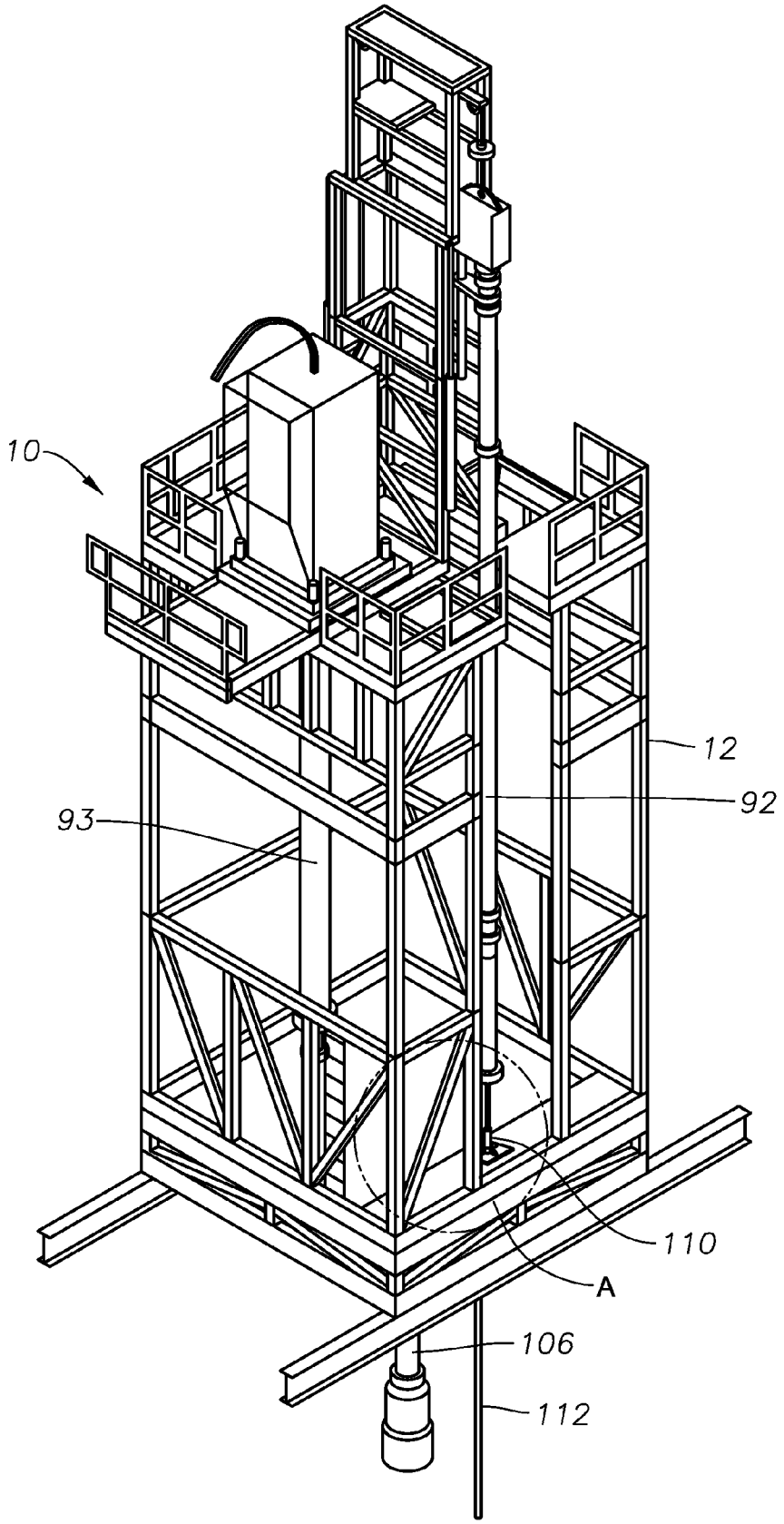
FIG. 23 is a perspective view of the well intervention apparatus with the wireline perforating gun disposed within a protective case.
Figure 24:
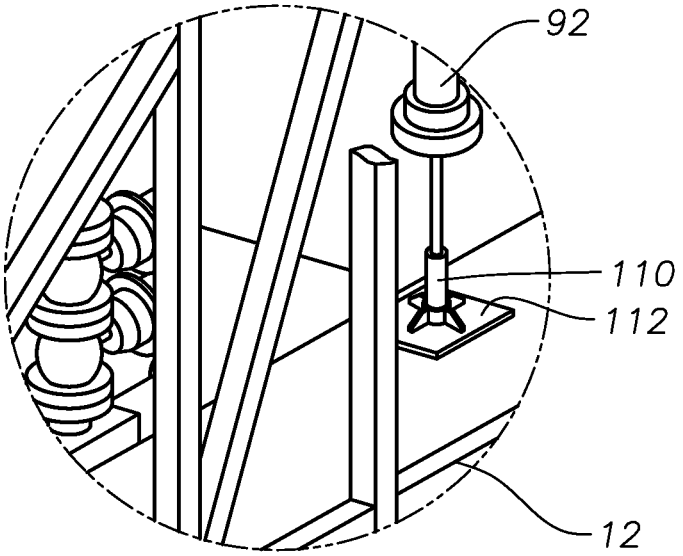
FIG. 24 is a partial view of the wireline perforating gun disposed within a protective case taken from section A of FIG. 23.

Referring to FIGS. 23-24, wireline perforating gun 110 may then be lowered into protective case 112 affixed to base frame assembly 12. Distal end 52 of auxiliary line 50 may be disconnected from wireline perforating gun 110. Wireline perforating gun 110 may be stored in protective case 112 until use is desired within the wellbore. When wireline perforating gun 110 is required, wireline lubricator assembly 92 may be transferred into the sideline position shown in FIGS. 20 and 23. Wireline 100 may then be attached to the upper end of wireline perforating gun 110, and wireline perforating gun 110 may be lifted by wireline lubricator assembly 92. Wireline lubricator assembly 92 may then be transferred back into the aligned position shown in FIGS. 16-17 and 21-22, and wireline lubricator assembly 92 may be fluidly connected to riser extension 106 in order to run wireline perforating gun 110 into riser extension 106 and into the subsea wellbore.

Figure 26:
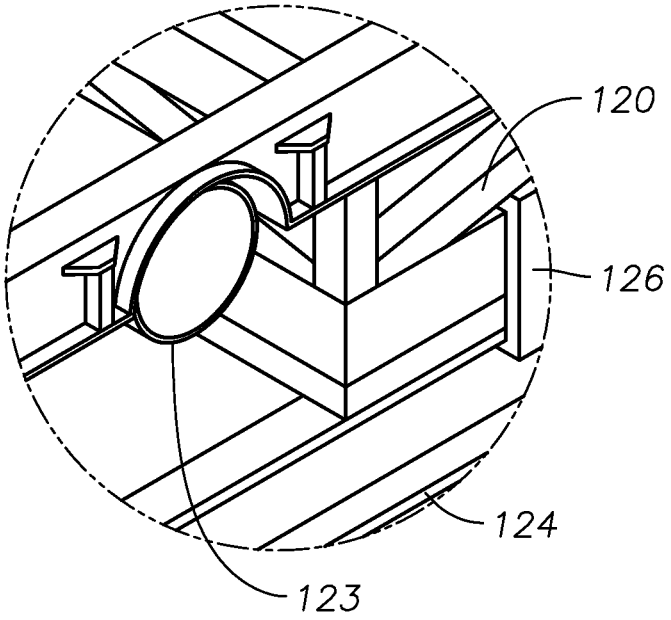
FIG. 26 is a partial view of the transfer assembly taken from section A of FIG. 25.
Figure 25:
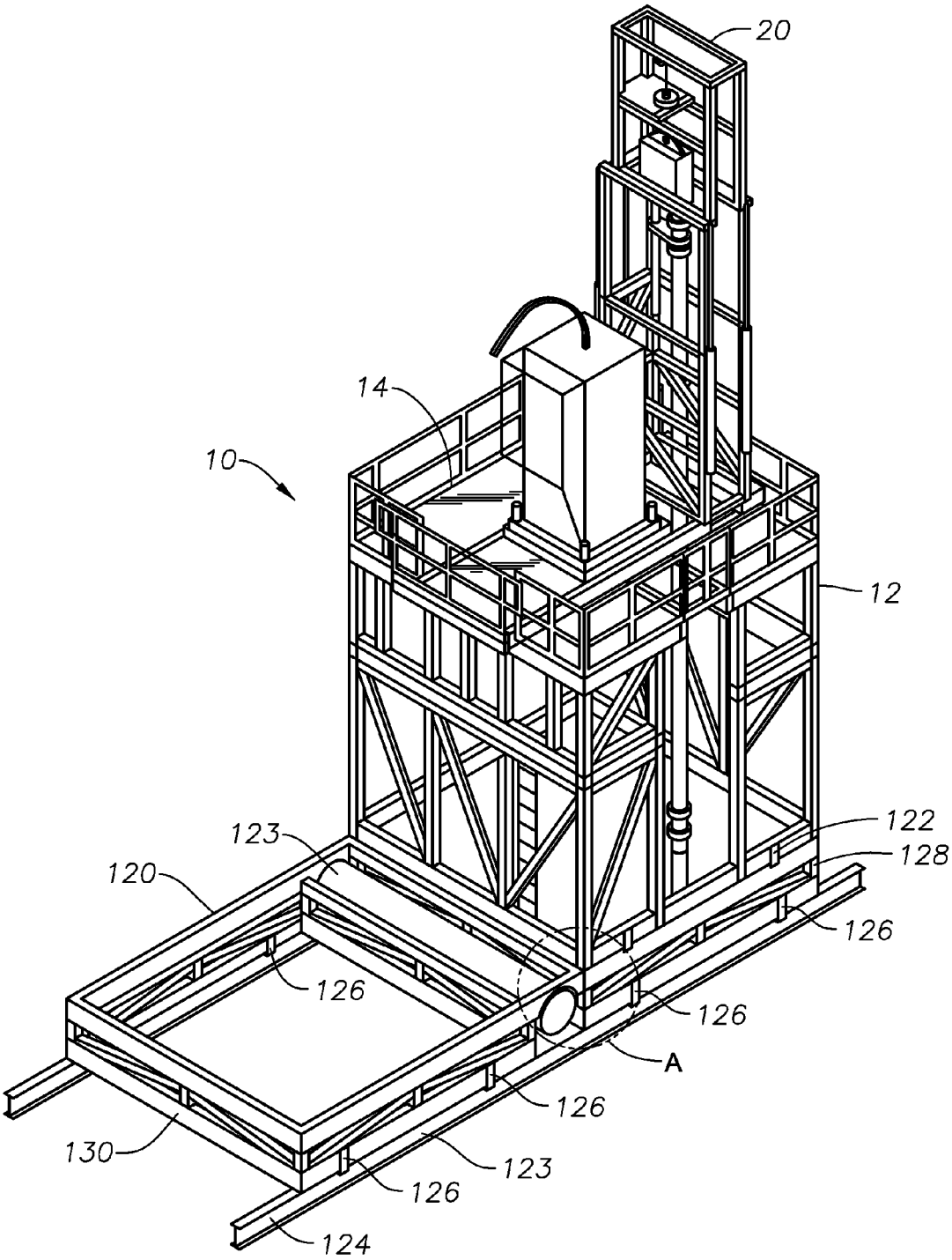
FIG. 25 is a perspective view of the well intervention apparatus positioned on a transfer assembly.

As shown in FIGS. 25 and 26, wireline intervention apparatus 10 may be mounted on a transfer assembly. Specifically, base frame assembly 12 may be affixed to transfer cart 120 with clamps 122. Wireline intervention apparatus 10 may be transferred from one side of transfer cart 120 to the opposite side of transfer cart 120 through the use of hydraulic cylinders or other suitable mechanisms known in the art. This movement of wireline intervention apparatus 10 may be facilitated by rotating member 123. Transfer cart 120 may be affixed to skid beam 124 with clamps 126. Transfer cart 120 may be transferred along the length of skid beam 124 through the use of hydraulic cylinders or other suitable mechanisms known in the art. The transfer assembly may be used on a platform having multiple risers leading to separate subsea wellbores, and wireline intervention apparatus 10 may be transferred across transfer cart 120 and along skid beam 124 to transfer well intervention apparatus 10 from a first riser to a second riser on the platform. For example, first section 128 of transfer cart 120 may be positioned over a first riser, and second section 130 of transfer cart 120 may be positioned over a second riser. Well intervention apparatus 10 may be transferred from first section 128 to second section 130 in order to utilize well intervention apparatus 10 with the second riser and a second subsea wellbore disposed below.

Figure 27:
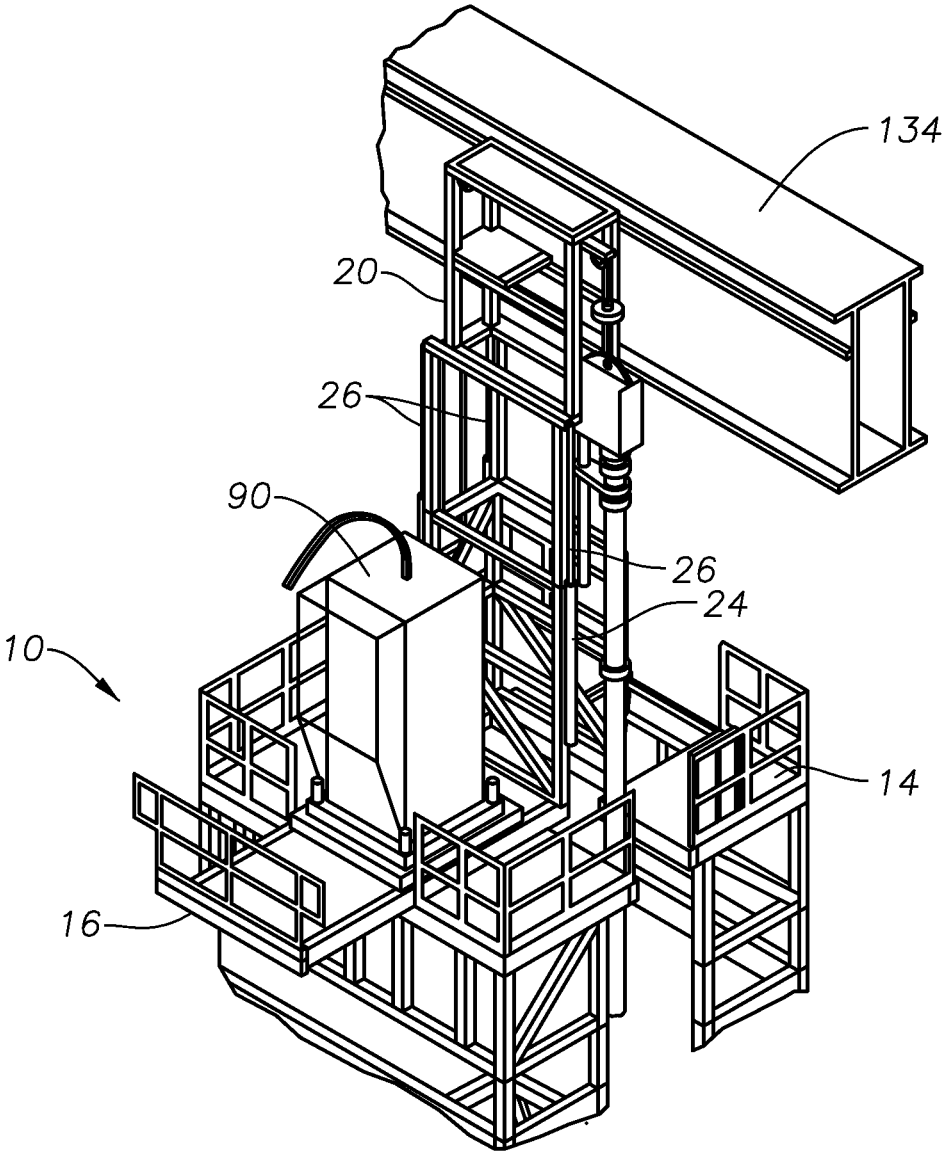
FIG. 27 is a partial perspective view of the well intervention apparatus positioned near an overhead obstruction.

FIG. 27 shows well intervention apparatus 10 positioned in a location on a platform that places tower 20 near obstruction 134. In this view, moveable plate 16 is in the second position. If coiled tubing is required for use in the wellbore located below the platform, moveable plate 16 will need to be placed into the first position to position coiled tubing injector head 90 over the wellbore, but the required movement of moveable plate 16 is not possible because tower 20 would collide with obstruction 134. Accordingly, tower 20 may be retracted by retracting pistons 26 into cylinders 24 (as described above in connection with FIGS. 1-5), thus allowing tower 20 to slide below obstruction 134 as moveable plate 16 is transferred into the first position.

While preferred embodiments have been described, it is to be understood that the embodiments are illustrative only and that the scope of the invention is to be defined solely by the appended claims when accorded a full range of equivalents, many variations and modifications naturally occurring to those skilled in the art from a review hereof.

The invention claimed is:

1. An apparatus for performing well intervention operations on a well, comprising:

a base frame assembly;

a deck attached to an upper end of the base frame assembly, the deck including a passage;

a track disposed within the passage;

a moveable plate slidingly attached to the track for movement within the passage;

a reception plate operatively attached to the moveable plate and positioned over a first aperture of the moveable plate, wherein the reception plate is configured to secure a first well intervention tool;

a tower mounted on the moveable plate such that the tower and the plate are moveable relative to the deck, the tower being positioned over a second aperture of the moveable plate;

a primary hoist assembly operatively connected to an upper end of the tower, wherein the primary hoist assembly is configured to suspend a second well intervention tool from the tower;

wherein in a first position of the moveable plate, the reception plate is disposed over the well, and wherein in a second position of the moveable plate, the tower is disposed over the well.

2. The apparatus of claim 1, wherein the deck further includes a hatch adjacent to the passage, the hatch configured to be opened for allowing communication with the passage.

3. The apparatus of claim 2, wherein the primary hoist assembly includes a primary drum operatively attached to a lower end of the tower, a first primary sheave and a second primary sheave each operatively connected to the upper end of the tower, and a support line disposed around the primary drum and engaging the first and second primary sheaves, wherein a distal end of the support line is suspended from the second primary sheave.

4. The apparatus of claim 3, further comprising an upper track affixed to the upper end of the tower, wherein the upper track is oriented perpendicularly relative to the track of the moveable plate, and wherein the second primary sheave is slidingly attached to the upper track.

5. The apparatus of claim 4, wherein the upper track includes a rack and pinion arrangement or a hydraulic cylinder arrangement for transferring the second primary sheave along the upper track.

6. The apparatus of claim 4, wherein the first well intervention tool includes a coiled tubing injector head and the second well intervention tool includes a wireline assembly.

7. The apparatus of claim 6, wherein the wireline assembly includes:

a block suspended from the distal end of the support line;

a wireline lubricator assembly and a wireline guide each suspended from the block;

a wireline drum operatively attached to a lower end of the tower;

a wireline disposed around the wireline drum and disposed through the wireline guide and the block, wherein the wireline guide and the block feed the wireline into the wireline lubricator assembly.

8. The apparatus of claim 7, further comprising a lower guide sheave operatively attached to the wireline lubricator assembly, wherein the wireline engages the lower guide sheave between the wireline drum and the wireline guide.

9. The apparatus of claim 7, further comprising an auxiliary hoist assembly including an auxiliary drum operatively attached to a lower end of the tower, a first auxiliary sheave and a second auxiliary sheave each operatively connected to the upper end of the tower, and an auxiliary line disposed around the auxiliary drum and engaging the first and second auxiliary sheaves, wherein a distal end of the auxiliary line is suspended from the second auxiliary sheave.

10. The apparatus of claim 7, further comprising a protective case affixed to a lower end of the base frame assembly below the hatch, the protective case dimensioned to house a wireline perforating gun; wherein in an aligned position of the second primary sheave along the upper track, the wireline lubricator assembly is disposed over the well; and wherein in a sideline position of the second primary sheave along the upper track, the wireline lubricator assembly is disposed through the hatch in an open position and over the protective case.

11. The apparatus of claim 1, further comprising a second track disposed within the first aperture of the moveable plate, wherein the reception plate is slidingly attached to the second track, and wherein the second track is oriented perpendicularly relative to the track of the moveable plate.

12. The apparatus of claim 1, wherein the tower includes at least one cylinder and piston mechanism for vertical extension and retraction of the tower.

13. The apparatus of claim 1, wherein the base frame assembly includes at least one cylinder and piston mechanism for vertical extension and retraction of the base frame assembly in response to a water level change in a water body over which the apparatus is positioned to maintain an elevation of the deck.

14. A method of performing well intervention operations on a well, comprising the steps of:

(a) providing a well intervention apparatus comprising: a base frame assembly; a deck attached to an upper end of the base frame assembly, the deck including a passage; a track disposed within the passage; a moveable plate slidingly attached to the track for movement within the passage; a reception plate operatively attached to the moveable plate and positioned over a first aperture of the moveable plate, wherein the reception plate is configured to secure a coiled tubing injector head; a tower mounted on the moveable plate such that the tower and the plate are moveable relative to the deck, the tower being positioned over a second aperture of the moveable plate; and a primary hoist assembly operatively connected to an upper end of the tower;

(b) positioning the well intervention apparatus on a platform above a well;

(c) attaching a first well intervention tool to the reception plate and suspending a second well intervention tool from the tower by the primary hoist assembly;

(d) selectively positioning the moveable plate in a first position in which the reception plate and the first well intervention tool are disposed over the well or in a second position in which the tower and the second well intervention tool is disposed over the well;

(e) fluidly connecting the first well intervention tool or the second well intervention tool to an upper end of a riser extending from the well;

(f) conducting well intervention operations on the well with the first well intervention tool or the second well intervention tool.

15. The method of claim 14, wherein the first well intervention tool includes a coiled tubing injector head and the second well intervention tool includes a wireline assembly;

wherein step (d) further comprises positioning the moveable plate in the first position in which the reception plate, the coiled tubing injector head, and a coiled tubing lubricator are disposed over the well;

wherein step (e) further comprises fluidly connecting the coiled tubing lubricator to the upper end of the riser;

wherein step (f) further comprises conducting coiled tubing operations on the well.

16. The method of claim 15, further comprising the steps of:

(g) disconnecting the coiled tubing lubricator from the riser;

(h) transferring the moveable plate from the first position into the second position in which the tower and the wireline assembly are disposed over the well;

(i) fluidly connecting the wireline assembly to the upper end of the riser;

(j) conducting wireline operations on the well.

17. The method of claim 14, wherein the first well intervention tool includes a coiled tubing injector head and the second well intervention tool includes a wireline assembly;

wherein step (d) further comprises positioning the moveable plate in the second position in which the tower and the wireline assembly are disposed over the well;

wherein step (e) further comprises fluidly connecting the wireline assembly to the upper end of the riser;

wherein step (f) further comprises conducting wireline operations on the well.

18. The method of claim 17, further comprising the steps of:

(g) disconnecting the wireline assembly from the riser;

(h) transferring the moveable plate from the second position into the first position in which the reception plate, the coiled tubing injector head, and a coiled tubing lubricator are disposed over the well;

(i) fluidly connecting the coiled tubing lubricator to the upper end of the riser;

(j) conducting coiled tubing operations on the well.

19. The method of claim 14, wherein the well intervention apparatus further comprises an auxiliary hoist assembly operatively connected to an upper end of the tower; wherein the primary hoist assembly is slidingly attached to an upper track affixed to the upper end of the tower; wherein the deck further includes a hatch adjacent to the passage; the method further comprising the steps of:

(g) placing the hatch in an open position;

(h) suspending a wireline perforating gun from the tower by the auxiliary hoist assembly;

(i) depositing the wireline perforating gun in a protective case attached to the base frame assembly below the hatch and disconnecting the wireline perforating gun from the auxiliary hoist assembly;

(j) laterally sliding the primary hoist assembly along the upper track from an aligned position in which the wireline assembly is disposed over the well to a sideline position in which the wireline assembly is disposed through the hatch and over the protective case;

(k) lifting the wireline perforating gun with the wireline assembly;

(l) laterally sliding the primary hoist assembly into the aligned position;

(m) fluidly connecting the wireline assembly to the upper end of the riser;

(n) running the wireline perforating gun into the riser.

20. The method of claim 14, wherein the well is a subsea well, and the base frame assembly includes at least one cylinder and piston mechanism; the method further comprising the steps of:

(g) vertically extending the base frame assembly with the cylinder and piston mechanism in response to a drop in a water level above the subsea well to maintain an elevation of the deck; and (h) vertically retracting the base frame assembly with the cylinder and piston mechanism in response to a rise in the water level above the subsea well to maintain an elevation of the deck.

* * * * *